US008196488B2

(12) United States Patent
O-Oka et al.

(10) Patent No.: US 8,196,488 B2
(45) Date of Patent: Jun. 12, 2012

(54) GEAR

(75) Inventors: Mitsushige O-Oka, Toyota (JP); Yoshiki Kawasaki, Toyota (JP); Mitsuhiko Shimomura, Toyota (JP)

(73) Assignee: O-Oka Corporation, Toyota (JP)

( * ) Notice: Subject to any disclaimer, the term of this patent is extended or adjusted under 35 U.S.C. 154(b) by 1170 days.

(21) Appl. No.: 12/005,386

(22) Filed: Dec. 27, 2007

(65) Prior Publication Data

US 2008/0210037 A1 Sep. 4, 2008

(30) Foreign Application Priority Data

Dec. 29, 2006 (JP) ..... 2006-356936

(51) Int. Cl.
*F16H 55/17* (2006.01)
*B21D 22/00* (2006.01)

(52) U.S. Cl. ..... 74/458; 29/893.34

(58) Field of Classification Search ..... 72/352, 72/358, 91, 344, 353–357, 359, 467, 253.1, 72/260; 76/107.1, 117, 107.4; 29/893.34, 29/893.32, 893.35; 419/28, 78, 38, 66; 74/458
See application file for complete search history.

(56) References Cited

U.S. PATENT DOCUMENTS 3,828,628 A * 8/1974 Roger ..... 76/107.1
5,052,210 A * 10/1991 Hoge ..... 72/467
5,295,382 A * 3/1994 Fuhrman ..... 72/343
5,544,548 A * 8/1996 Iihara et al. ..... 76/107.1
6,383,447 B1 * 5/2002 Nakata et al. ..... 419/66
6,470,728 B2 * 10/2002 Sekiguchi ..... 72/344
7,025,929 B2 * 4/2006 Trasorras et al. ..... 419/28
7,347,076 B1 * 3/2008 Cha ..... 72/344
7,677,073 B2 * 3/2010 Tanabe ..... 72/352

FOREIGN PATENT DOCUMENTS

| | | |
|---|---|---|
| EP | 1 500 849 A1 | 1/2005 |
| JP | A-2-63632 | 3/1990 |
| JP | A 11-300446 | 11/1999 |
| JP | A-2000-233257 | 8/2000 |
| JP | A-2002-120038 | 4/2002 |
| JP | A 2002-282992 | 10/2002 |
| WO | WO 03/091604 A1 | 11/2003 |

OTHER PUBLICATIONS

Notification of Reason for Refusal issued in Japanese Patent Application No. 2006-356936; mailed Jul. 19, 2011; with English-language translation.

* cited by examiner

*Primary Examiner* — Robert Pezzuto
(74) *Attorney, Agent, or Firm* — Oliff & Berridge, PLC

(57) ABSTRACT

A helical gear having helical tooth portions of the helical gear being worked by a punch and a die having a land of a smaller distance between opposed working surfaces formed to be inclined than that of other portion, formed on predetermined portions in tooth directions of respective opposed working surfaces thereon, in which worked surfaces on both side of the helical tooth portions on the helical gear as a work are ironed by the land in response to the helical tooth portions passing through the land when the work is forged by the punch.

6 Claims, 16 Drawing Sheets

VIEW A

Punch
Die
3
111
112
11
221
220
222
212
22
211
Work putting-in 3
11
221
220
222
112
22
111
During forming 3
221
220
222
112
22
111
11
Completion of forming 11
111
112
221
220
222
22
During demolding Work putting-in During forming Completion of forming During demolding Work putting-in
Die
3
112
11
111
221
220
222
22
211
212

During forming
11
3
111
22
221
220
222
112

Completion of forming
3
22
111
11
221
220
222
112

During demolding
22
11
111
221
220
222
112

GEAR

BACKGROUND

1. Field of the Invention

This invention relates to a change gear for automobiles, i.e., a helical gear, a device and a method for manufacturing the helical gear.

2. Description of the Prior Art

In manufacturing of a change gear to be used for a speed-changing transmission of an automobile, first, hobbing is performed as shown in FIG. 16, shaving is applied to a hobbed work, and a shaved work is subjected to heat treatment, whereby a gear is formed through the series of machining and treatment.

In the state before the heat treatment, the work includes internal stresses. The internal stresses released by the heat treatment cause heat treatment distortion and deform the work. The internal stresses are not uniform (equal), so that the deformation is complicated.

Therefore, accuracies before and after the heat treatment are measured and a shape in expectation of the deformation is fed back to the shaving cutter. However, a trial of the series of processes shown in FIG. 16, must be repeated a plurality of times. Alternatively, hard machining after the heat treatment is added. However, this increases the number of processes.

As shown in FIG. 17A, in conventional helical gears and helical gear manufacturing apparatuses and methods, in a die for working helical tooth portions of a helical gear as a work, when the work is pressure-forged with a punch by opposed working surfaces at a fixed distance formed so as to be inclined, worked surfaces on both sides of the helical tooth portions are ironed during the helical tooth portions passing through the die between the opposed working surfaces.

As shown in FIGS. 17A and 17B, in the above-described conventional helical gears and helical gear manufacturing apparatuses and methods, in a die for working helical tooth portions of a helical gear as a work, when the work is pressure-forged with a punch by opposed working surfaces at a fixed distance formed so as to be inclined, worked surfaces on both sides of the helical tooth portions are ironed during the helical tooth portions passing through the die between the opposed working surfaces. Therefore, in forge-forming, by using the spread of a material in the die under pressure, the material is spread to a predetermined size. However, as shown in FIG. 17B, the distribution of the internal stress strength and the direction thereof are not uniform and some portion shrinks due to buckling depending on the location. Therefore, in normal forging, a portion expanded under pressure and a portion shrunk by buckling are mixed. This increases heat treatment distortion.

As shown in FIG. 18, in the conventional manufacturing method using machining such as bobbing, grain flow of a material is cut by gear cutting, so that this also increases heat treatment distortion.

In the conventional manufacturing apparatus for forging by using a die shown in FIG. 17A to obtain a predetermined helix angle on the helical tooth portions, it is necessary that a helix angle and a helix angle correction amount of the work are obtained in advance as shown in FIG. 19 and a helix angle of the die is set in advance to be greater than that of the work.

Therefore, the inventor of the present invention focused on the fact that by making uniform, that is, equal, the vectors of internal stresses in the work before heat treatment, the heat treatment distortion could be minimized. Herein, "uniform" and "equal" are in both the stress direction (tension and compression) and the degree of stresses.

Therefore, the inventor of the present invention focused on the technical idea of the present invention in which, in a die for working helical tooth portions of a helical gear as a work, by lands formed on predetermined portions in tooth trace directions of opposed working surfaces formed to be inclined by making smaller a distance between opposed working surfaces than that of other portions, when the work was pressure-forged with a punch, worked surfaces on both sides of the helical tooth portions were ironed when the helical tooth portions passed through the lands. The inventor, as a result of repeated research and development, arrived at the present invention which realized the object to minimize the heat treatment distortion by making uniform, that is, equal, the vectors of internal stresses in the work.

SUMMARY

It is a general object of the present invention to provide a helical gear which comprises helical tooth portions of the helical gear being worked by a punch and a die having a land of a smaller distance between opposed working surfaces formed to be inclined than that of other portion, formed on predetermined portions in tooth directions of respective opposed working surfaces thereon, in which worked surfaces on both sides of the helical tooth portions on the helical gear as a work are ironed by the land in response to the helical tooth portions passing through the land when the work is forged by the punch.

A more specific object of the present invention is to provide an apparatus for manufacturing a helical gear which comprises a die for working helical tooth portions of the helical gear as a work and a land having a smaller distance between opposed working surfaces formed to be inclined than that of other portions formed on predetermined portions in tooth directions of respective opposed working surfaces on the die, and a punch for forging the work, in which worked surfaces on both side of the helical tooth portions on the helical gear are ironed by the land in response to the helical tooth portions passing through the lands when the work is forged by the punch.

Another object of the present invention is to provide the apparatus for manufacturing a helical gear in which a helix angle of the opposed working surfaces to the axial direction of the die is different from a helix angle of the helical tooth portions of the helical gear as a work.

A further object of the present invention is to provide the apparatus for manufacturing a helical gear in which the helix angle of the opposed working surfaces of the die is greater than the helix angle of the helical tooth portions of the helical gear as a work.

A further object of the present invention is to provide the apparatus for manufacturing a helical gear in which the land has an entrance tapered portion at which the distance between opposed surfaces becomes gradually narrower, and an exit tapered portion at which the distance between opposed surfaces becomes gradually wider.

A further object of the present invention is to provide the apparatus for manufacturing a helical gear in which a parallel portion with a constant distance between opposed surfaces is formed between the entrance tapered portion and the exit tapered portion.

Yet a further object of the present invention is to provide the apparatus for manufacturing a helical gear in which an ironing allowance of a working surface on an acute-angled surface side of the land is set to be larger than an ironing allowance on an obtuse-angled surface side.

Another object of the present invention is to provide a method for manufacturing a helical gear in a die for working helical tooth portions of the helical gear as a work having a land of a smaller distance between opposed working surfaces formed to be inclined than that of other portions formed on predetermined portions in tooth directions of respective opposed working surfaces on the die in which worked surfaces on both side of the helical tooth portions on the helical gear are ironed by the land in response to the helical tooth portions passing through the land when the work is forged by a punch.

A helical gear according to the first aspect of the present invention, having the construction described above, comprises helical tooth portions of the helical gear being worked by a punch and a die having a land of a smaller distance between opposed working surfaces formed to be inclined than that of other portions formed on predetermined portions in tooth directions of respective opposed working surfaces thereon, in which worked surfaces on both side of the helical tooth portions on the helical gear as a work are ironed by the land in response to the helical tooth portions passing through the land when the work is forged by the punch. Accordingly, the present invention has such effects that by making the vectors of internal stresses in a work uniform, i.e., equal, manufacturing of a helical gear with minimized heat treatment distortion is enabled.

An apparatus for manufacturing a helical gear according to the second aspect of the present invention, having the construction described above, comprises a die for working helical tooth portions of the helical gear as a work and a land having a smaller distance between opposed working surfaces formed to be inclined than that of other portions formed on predetermined portions in tooth directions of respective opposed working surfaces on the die, and a punch for forging the work, in which worked surfaces on both sides of the helical tooth portions on the helical gear are ironed by the land in response to the helical tooth portions passing through the lands when the work is forged by the punch. Therefore, the present invention has such effects that by making the vectors of internal stresses in a work uniform, i.e., equal, manufacturing of a helical gear with minimized heat treatment distortion is enabled.

In an apparatus for manufacturing a helical gear according to the third aspect of the present invention having the construction described above, a helix angle of the opposed working surfaces to the axial direction of the die is different from a helix angle of the helical tooth portions of the helical gear as a work. Therefore, the present invention has such effects that making the vectors of internal stresses on the tooth flanks after forging uniform is enabled.

In an apparatus for manufacturing a helical gear according to the fourth aspect of the present invention having the construction described above, the helix angle of the opposed working surfaces of the die is greater than the helix angle of the helical tooth portions of the helical gear as a work. Accordingly, the present invention has such effects that making the vectors of internal stresses on the tooth flanks after forging uniform is enabled.

In the apparatus for manufacturing a helical gear according to the fifth aspect of the present invention having the construction described above, the land has an entrance tapered portion at which the distance between opposed surfaces becomes gradually narrower, and an exit tapered portion at which the distance between opposed surfaces becomes gradually wider.

Therefore, the present invention has an effect that worked surfaces on both sides of helical tooth portions can be smoothly ironed when the helical tooth portions pass through the lands, when the work is pressure-forged with a punch.

In the apparatus for manufacturing a helical gear according to the sixth aspect of the present invention having the construction described above, a parallel portion with a constant distance between opposed surfaces is formed between the entrance tapered portion and the exit tapered portion. Therefore, the present invention brings about an effect that reliable and uniform ironing is enabled.

In the apparatus for manufacturing a helical gear according to the seventh aspect of the present invention having the construction described above, an ironing allowance of a working surface on an acute-angled surface side of the land is set to be larger than an ironing allowance on an obtuse-angled surface side.

Accordingly, the present invention has such effects that making the vectors of internal stresses on the tooth flanks after forging more uniform is enabled.

In the apparatus for manufacturing a helical gear according to the eighth aspect of the present invention having the construction described above, in a die for working helical tooth portions of the helical gear as a work, having a land of a smaller distance between opposed working surfaces formed to be inclined than that of other portions formed on predetermined portions in tooth directions of respective opposed working surfaces on the die, worked surfaces on both side of the helical tooth portions on the helical gear are ironed by the land in response to the helical tooth portions passing through the land when the work is forged by a punch. Accordingly, the present invention has such effects that by making the vectors of internal stresses in a work uniform, i.e., equal, manufacturing of a helical gear with minimized heat treatment distortion is enabled.

DETAILED DESCRIPTION OF EMBODIMENTS

Figure 1:
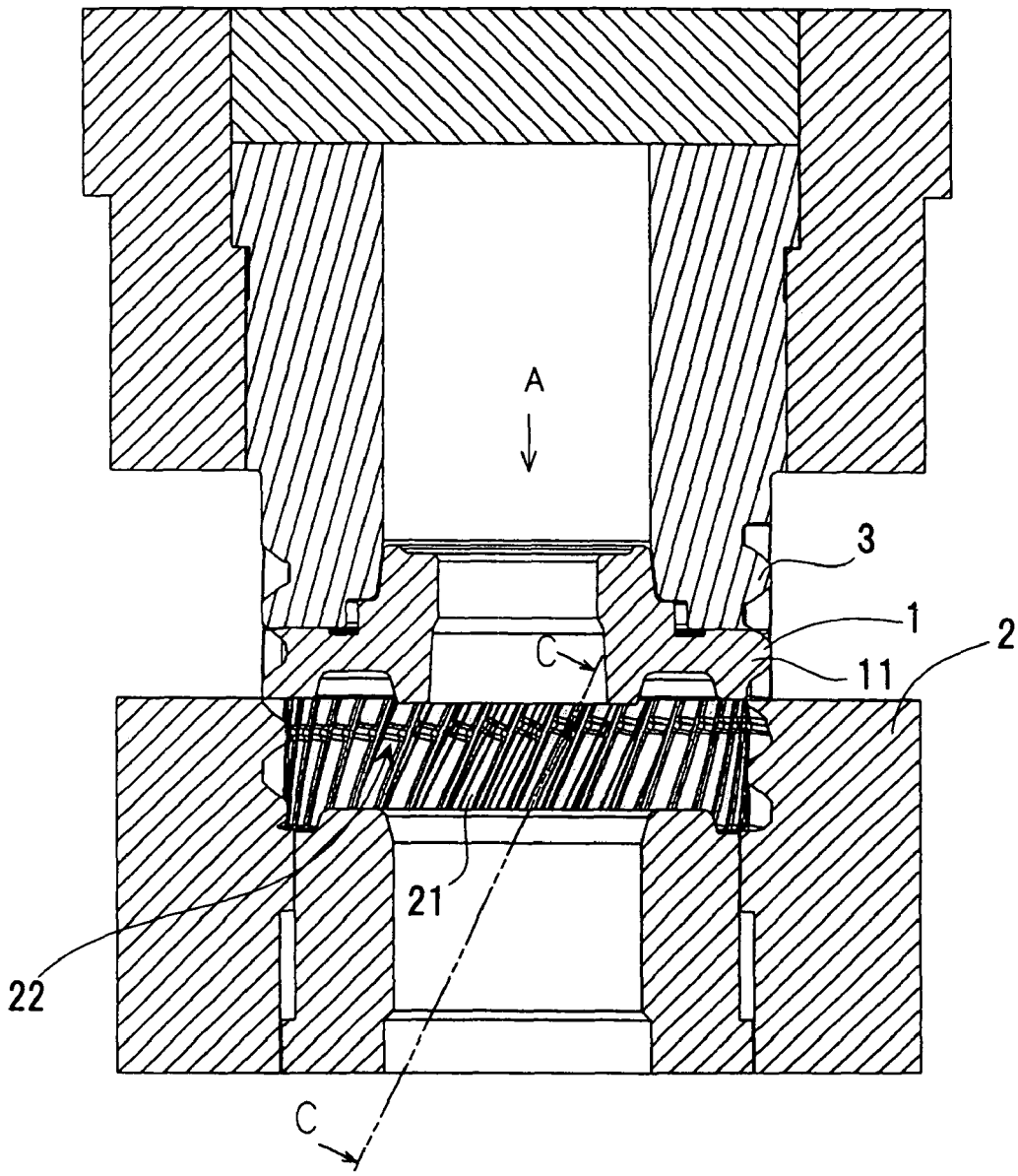
FIG. 1 is a longitudinal sectional view showing an entire assembly drawing of the die in the apparatus for manufacturing the helical gear according to the first embodiment of the present invention.
Figure 2:
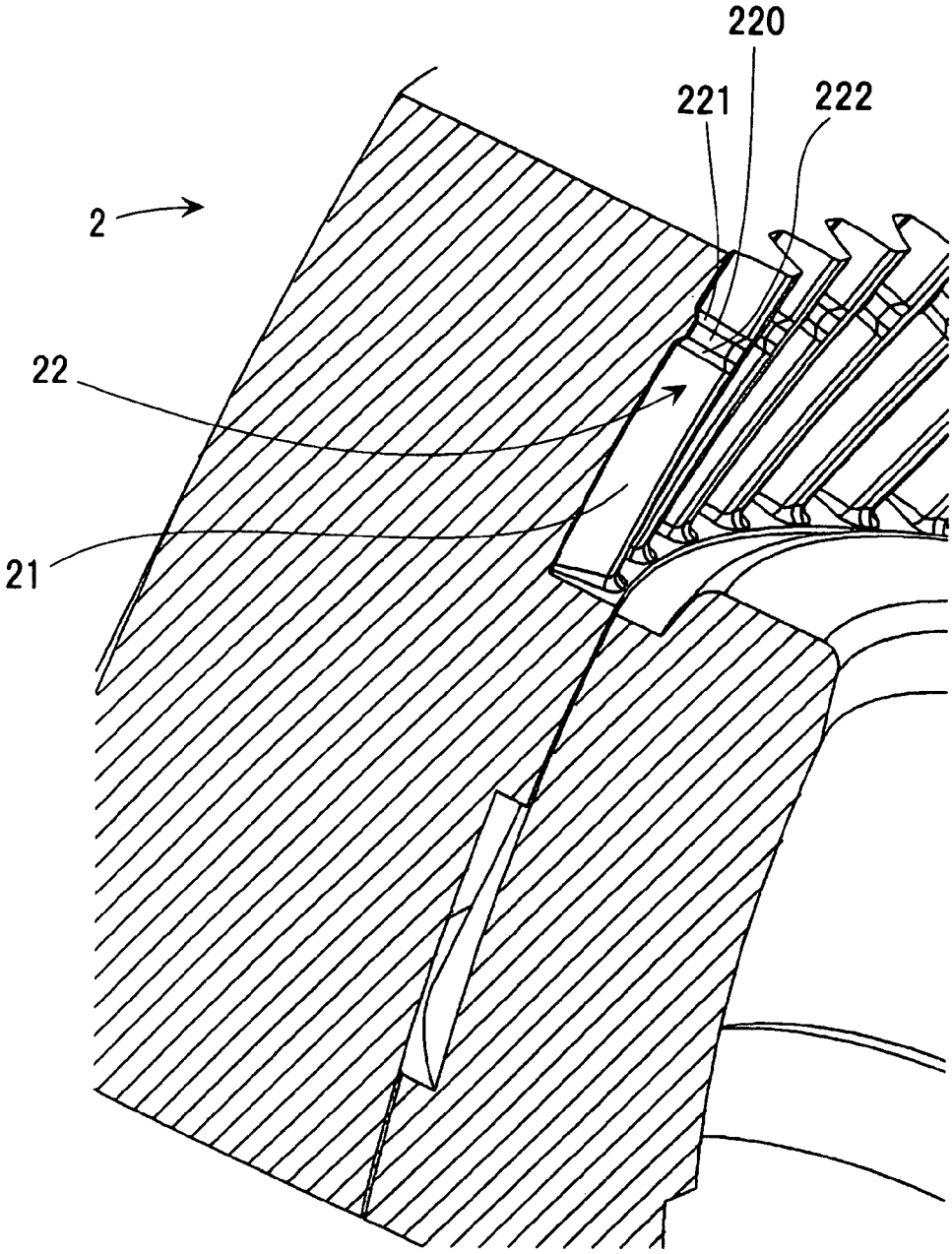
FIG. 2 is a partial sectional oblique perspective view along the C-C line in FIG. 1, showing the die according to the first embodiment of the present invention.
Figure 3A:
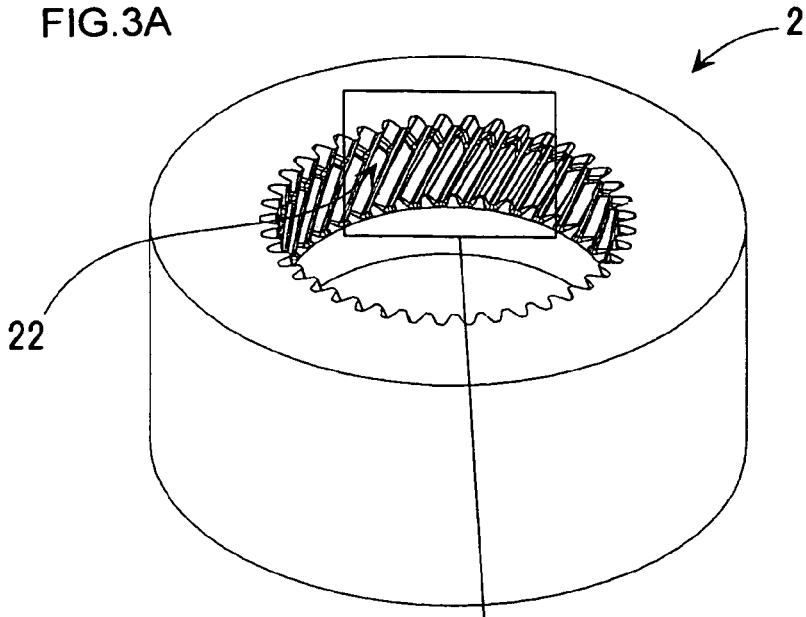
FIGS. 3A and 3B are an entire oblique perspective view and a partial enlarged perspective view showing a whole and a part of the die according to the first embodiment of the present invention.
Figure 3B:
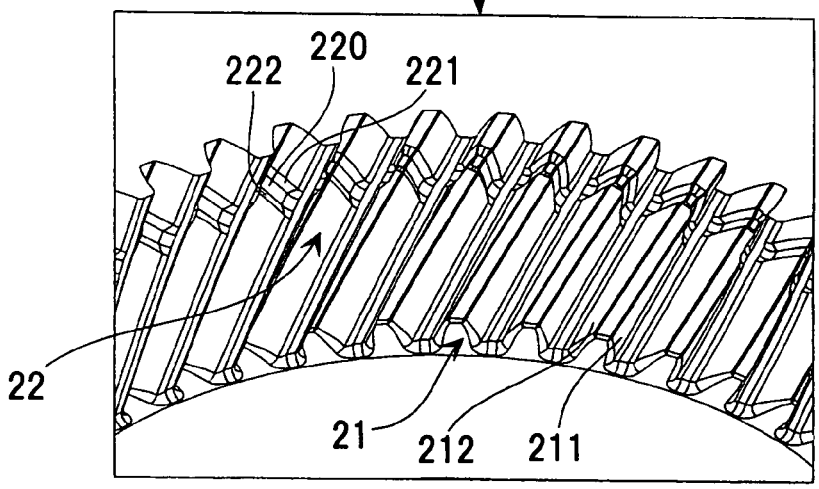
Figure 4:
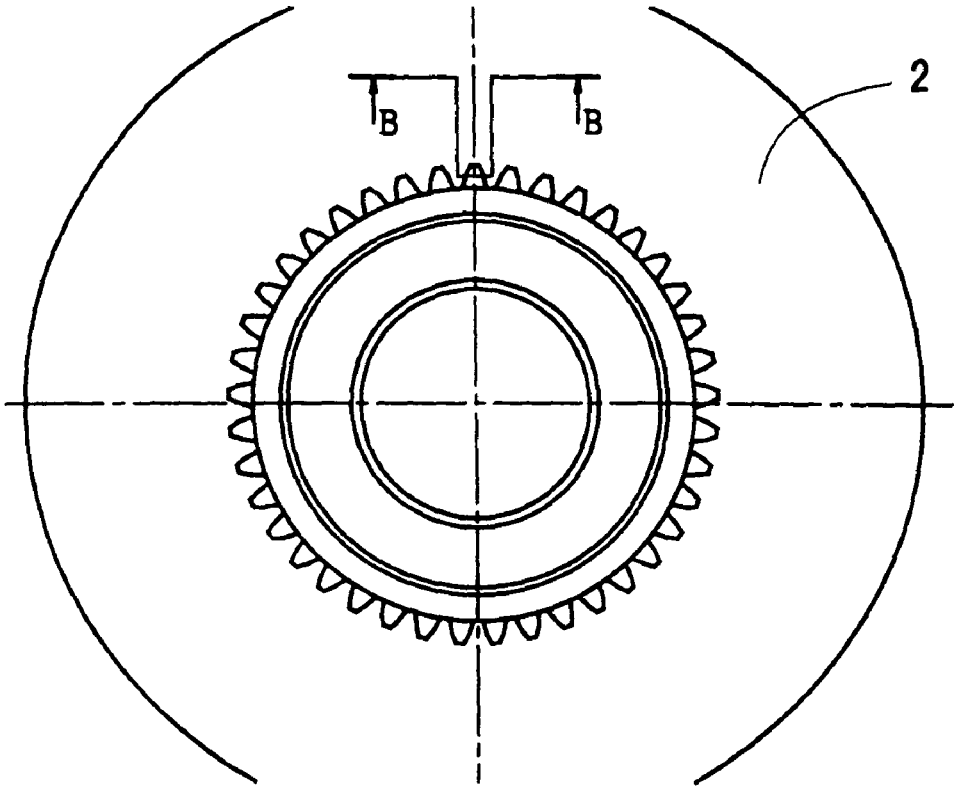
FIG. 4 is a plane view showing the die from the direction A in FIG. 1 according to the first embodiment of the present invention.

An embodiment of the present invention will be described with reference to the drawings.

First Embodiment

A helical gear according to a first embodiment, as shown in FIGS. 1-10, comprises helical tooth portions 11 of the helical gear being worked by a punch 3 and a die 2 having a land 22 of a smaller distance between opposed working surfaces 21 formed to be inclined than that of other portions formed on predetermined portions in tooth directions of respective opposed working surfaces 21 thereon, in which worked surfaces on both side of the helical tooth portions 11 on the helical gear as a work are ironed by the land 22 in response to the helical tooth portions 21 passing through the land 22 when the work 1 is forged by the punch 3.

Worked surfaces on both sides of the helical tooth portions 11 on the helical gear are ironed by the land 22 in response to the helical tooth portions 11 passing through the land 22 when the work 1 is forged by a punch 3 in an apparatus and a method for manufacturing a helical gear according to a first embodiment, in a die 2 for working helical tooth portions 11 of the helical gear as a work having a land 22 of a smaller distance between opposed working surfaces formed to be inclined than that of other portions, formed on predetermined portions in tooth directions of respective opposed working surfaces on the die.

The forge-forming of a helical gear according to the first embodiment is based on a forming method using a general pressing machine.

The apparatus for manufacturing a helical gear according to the first embodiment of the present invention comprises, as shown in FIGS. 1-5, a punch 3 which pushes the work 1 into a die 2 on which working inner surfaces for forming the work 1 are formed.

In the die 2, as shown in FIGS. 1-5, lands 22 are formed on predetermined portions in tooth trace directions of opposed working surfaces 21 formed to be inclined for working the helical tooth portions 11 of the helical gear as the work 1 by making smaller the distance between the opposed working surfaces than that of other portions. When the work 1 is pressure-forged with a punch 3, worked surfaces on both sides of the helical tooth portions 11 are ironed when the helical tooth portions 11 pass through the lands 22.

Figure 6A:
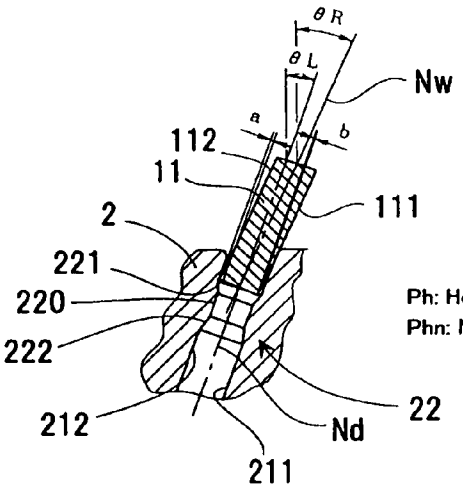
FIGS. 6A-6C are partial enlarged sectional views explaining the case that is set to be equal between ironing allowance and helix angle, the case that the helix angle is set to be equal between the work and the die, and the case that the helix angle is set to be different between the work and the die.

In the die 2, as shown in FIG. 6A, a helix angle θL of a neutral line Nd of the opposed working surfaces 211 and 212 formed to be inclined for working the helical tooth portions 11 of the helical gear as a work 1 is set to be greater than a helix angle θR of a neutral line Nw of the helical tooth portion 11 of the helical gear having worked surfaces 111 and 112 on both sides as a work 1.

Hereinafter, the reason for setting the difference between the helix angle of the work and the helix angle of the die will be described.

Figure 6B:
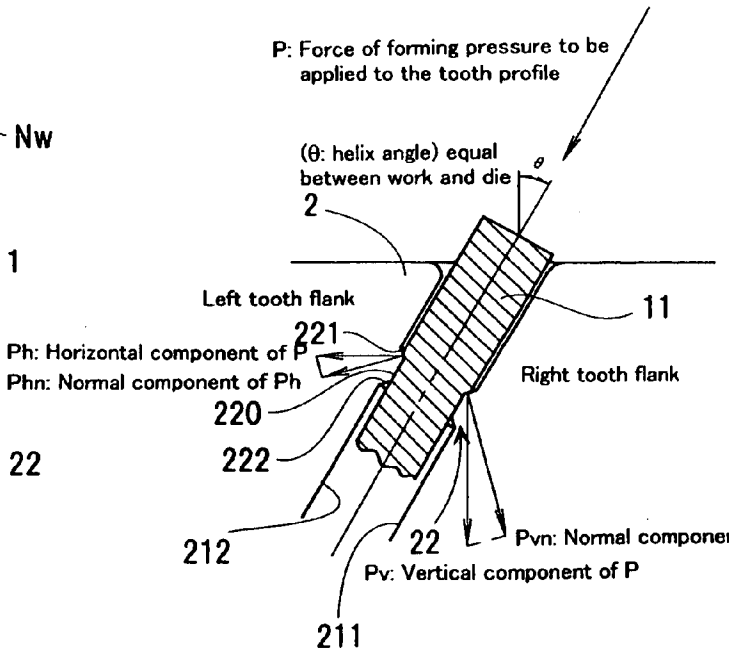

FIG. 6B is a schematic view of forming when the helix angle is set to be equal between the work and the die.

In FIG. 6B, P indicates a forming pressure perpendicular to the tooth profile. When assuming that the left tooth flank is subjected to a horizontal component force (Ph) of P and the right tooth flank is subjected to a vertical component force (Pv) of P, normal component forces perpendicular to tapered portions of both tooth flanks are as shown in the figure.

Herein, a helix angle of a die to be used regularly is 15 to 35 degrees, so that Pv>Ph and Pvn>Phn.

In FIG. 6B,

P: force of forming pressure to be applied to tooth profile (θ: helix angle) equal between work and die Left Tooth Flank Ph: horizontal component force of P Phn: normal component force of Ph Right Tooth Flank Pvn: normal component force of Pv Pv: vertical component force of P The normal component forces Phn and Pvn change along the tooth profile shapes. The forces to be applied to the tooth flanks 211 and 212 of the die are products of pressures per unit area and pressure receiving areas, so that the greater force is applied to the right tooth flank in the figure if ironing allowances in the normal directions are uniform.

Therefore, when the helix angle is equal between the work and the die, the internal stresses to be applied to the right tooth flank and the left tooth flank are always different from each other.

Figure 6C:
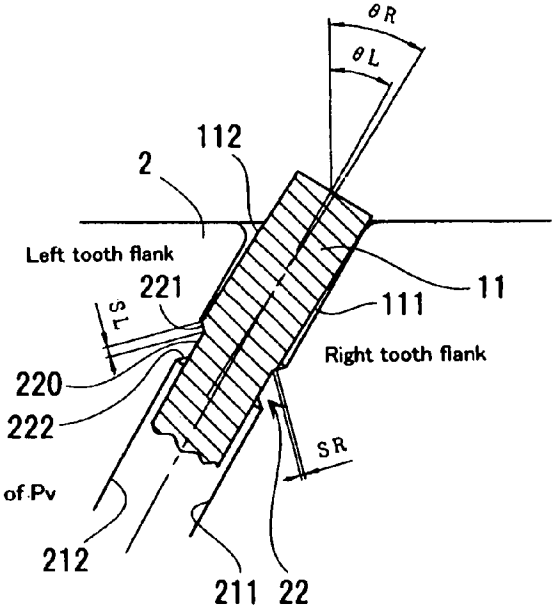

In FIG. 6C,

θL: helix angle of die

θR: helix angle of work

θR>θL (work has greater helix angle than of die)

SR: pressure receiving surface of right tooth flank

SL: pressure receiving surface of left tooth flank

SL>SR (receiving surface is larger on the left tooth flank than on the right tooth flank)

In the first embodiment, the helix angle of the helical tooth portions 11 of the work and the helix angle of the lands 22 of the die are set to be different from each other.

In order to make the internal stresses between the tooth flanks after being forged uniform, an angle difference is previously set between the die and the work as to satisfy θR>θL. As a result, with respect to areas SR and SL of left and right tapered portions of the entrance tapered portion 221 of the land 22 as pressure receiving surfaces, the area of the left tooth flank 112 is larger, whereby uniform internal stresses are applied to the left tooth flank 112 and the right tooth flank 111.

Figure 7:
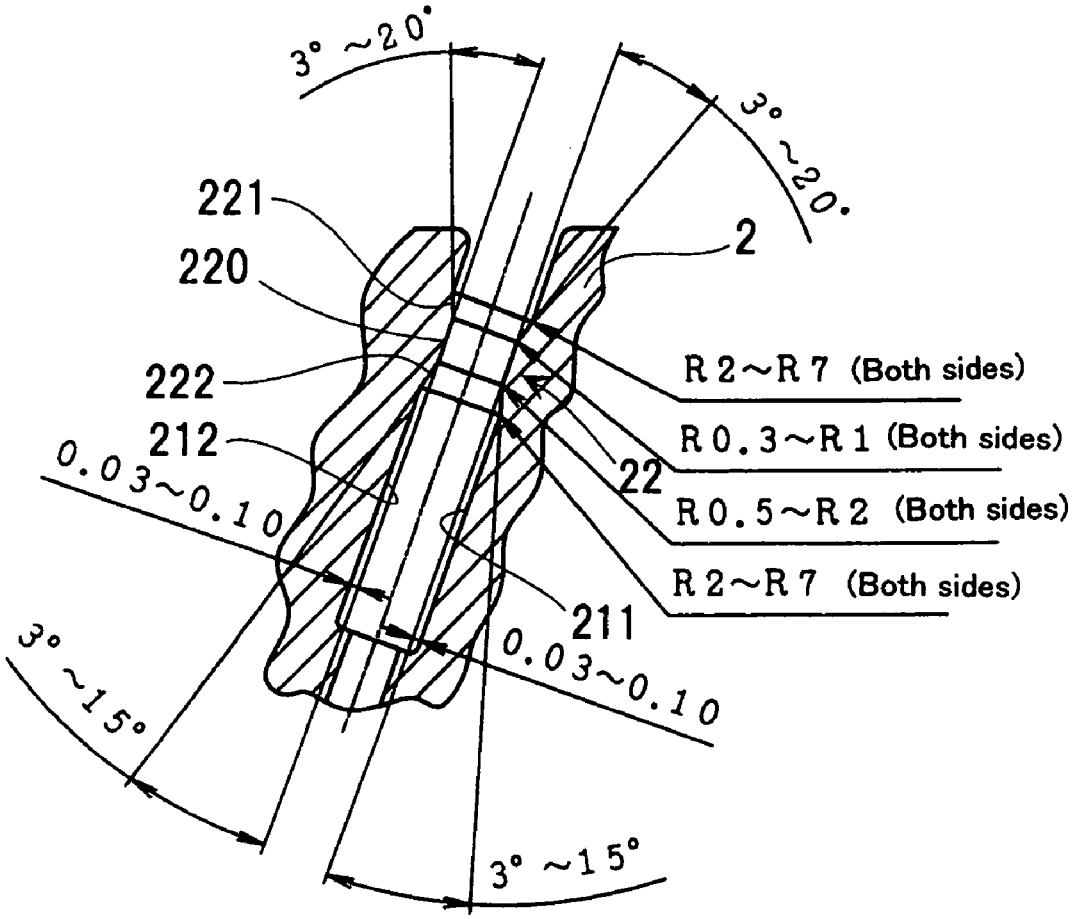
FIG. 7 is a partial enlarged sectional view explaining each setting of the land according to the first embodiment of the present invention.

The land 22 is formed on a predetermined portion on an upper side from the center of a tooth trace direction on each opposed working surfaces 21 formed to be inclined in the die 2 for working the helical tooth portions 11 of the helical gear as the work 1 as shown in FIG. 7.

The land 22 has an entrance tapered portion 221 at which the distance between opposed surfaces becomes gradually narrower, an exit tapered portion 222 at which the distance between the opposed surfaces becomes gradually wider, and a parallel portion 220 which is formed between the entrance tapered portion 221 and the exit tapered portion 222 and at which the distance between opposed surfaces is constant and shortest.

The entrance tapered portion 221 of the land 22 is set to have an appropriate angle in the range of 3 to 20 degrees as shown in FIG. 7, the entrance portions on both sides of the entrance tapered portion 221 are chamfered to R2 to R7, and the exit portions on both sides of the entrance tapered portion 221 are chamfered to R0.3 to R1.

The exit tapered portion 222 of the land 22 is set to have an appropriate angle in the range of 3 to 15 degrees as shown in FIG. 7, the entrance portions on both sides of the exit tapered portion 222 are chamfered to R0.5 to R2, and the exit portions on both sides of the exit tapered portion 222 are chamfered to R2 to R7.

The land 22 is set so that an ironing allowance a (0.3 to 0.6 mm) on the acute-angled surface side (left side in FIGS. 6A-6C) of each of the opposed working surfaces 211 and 212 is greater than an ironing allowance b (0.1 to 0.3 mm) on the obtuse-angled surface side (right side in FIGS. 6A-6C). However, depending on the circumstances, it is allowed that the ironing allowance of the working surface on the acute-angled surface side and the ironing allowance of the working surface on the obtuse-angled surface side are equal to each other.

In this first embodiment, the work 1 is put in the die 2 (mold) having the above-described lands 22, pressure-forged and ironed with the punch 3, and as a matter of course, the width of the work is set to be slightly wider than the inner width (minimum spacing between opposed surfaces) of the land 22 so as to obtain an appropriate ironing amount.

By crowning the portions at which the work will be present after being completely formed in the tooth trace directions in conjunction with the elastic recovery action of the work 1, tooth trace crowning can be formed on the work in the apparatus and a method for manufacturing a helical gear of the first embodiment.

A forge-forming method in the apparatus for manufacturing a helical gear of the first embodiment constructed as described above will be described with reference to FIGS. 1-8.

As shown in FIG. 1, the work 1 is put in the die 2 in which the lands 22, each including the above-described entrance tapered portion 221, exit tapered portion 222, and parallel portion 220 are formed and pressure-forged with the punch 3.

Figures 8A, 8B, 8C, 8D:
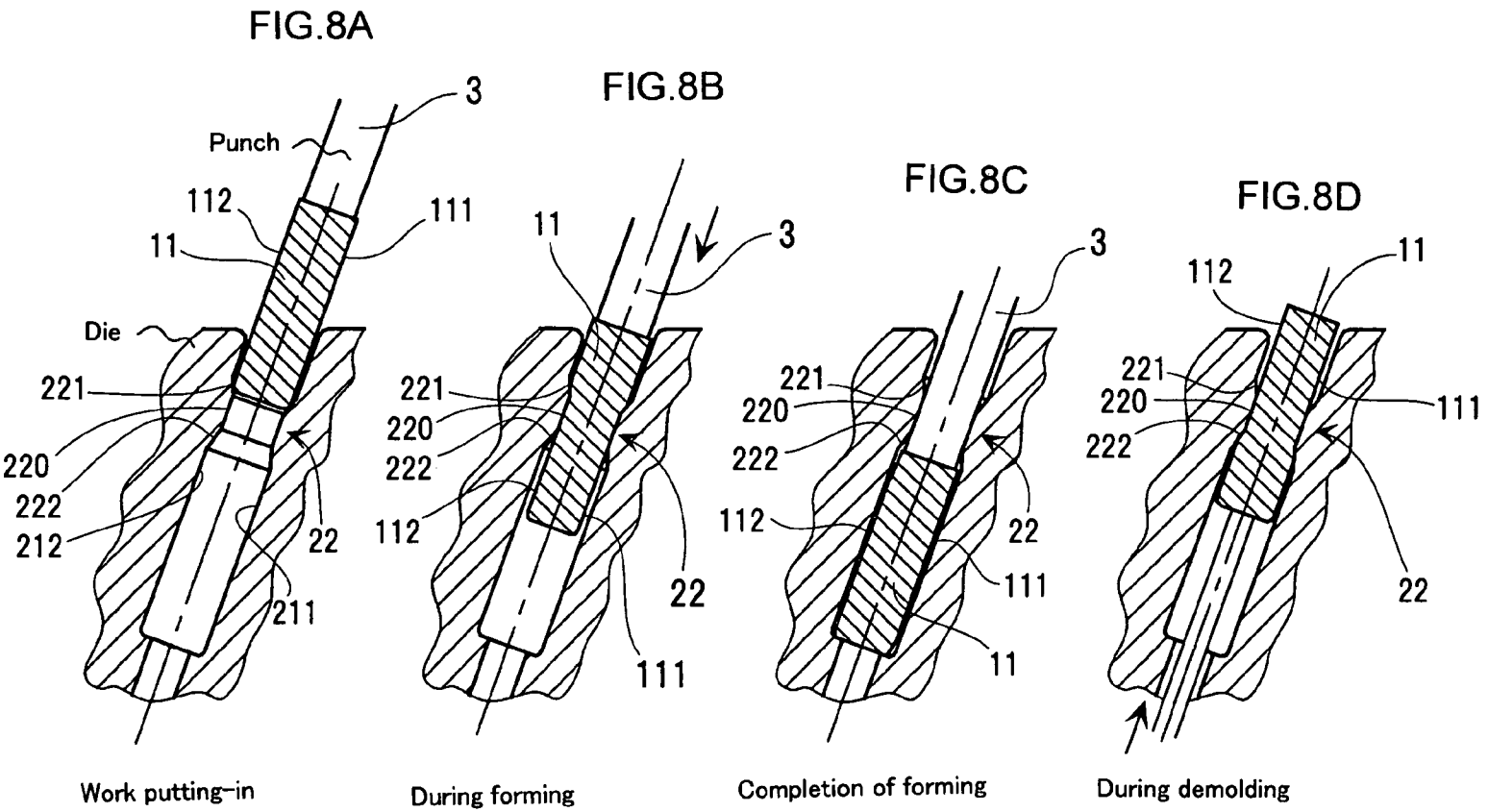
FIGS. 8A-8D are the first each partial enlarged sectional view explaining each molding process according to the first embodiment of the present invention.

As shown in FIGS. 8A and 8B, as the punch 3 lowers, the helical tooth flanks 11 of the work 1 are successively formed by the parallel portions 220 of the lands 22. However, at the time of completion of forming, internal stresses are not uniform, and are set so as to be greater in the right tooth flank 111 in the drawings than in the left tooth flanks 112.

As shown in FIG. 8C, as a feature of the work 1 at the time of completion of forming, the helical tooth flanks 11 of the work 1 pushed into the bottom of the die by the punch 3 are wider than the inner widths of the lands 22 due to spreading according to the pressing-down. This becomes an ironing amount when demolding as described below.

From this state, as shown in FIG. 8D, the helical tooth flanks 11 of the work 1 are pushed up for demolding. At this time, the helical tooth flanks 11 of the work 1 are pressure-forged again by the lands 22, and then the left tooth flanks 112 are strongly pressure-forged to the contrary. As a result, uniform internal stresses can be applied to the left and right tooth flanks 111 and 112 of the helical tooth flanks 11 of the work 1 completely demolded.

In this first embodiment, the upper and lower ends of the helical tooth portion 11 are inclined with respect to the horizontal plane so as to apply ironing to the worked surfaces 111 and 112 on both sides of the helical tooth portion 11 perpendicularly from both sides when the helical tooth portion 11 passes through the parallel portion 220 of the land 22 when the work 1 is pressure-forged with the punch 3, so that the upper and lower ends of the helical tooth portion 11, after being formed, are cut to be horizontal as needed by reason of limitation on the shaft length, avoiding interference or other reasons.

In the apparatus and a method for manufacturing a helical gear of the first embodiment, to the left and right tooth flanks 111 and 112 of the helical tooth flank 11 of the work 1 formed according to the method described above, uniform internal stresses are applied at the time of demolding, so that deformation after heat treatment can be minimized.

In the work 1 formed into a drum shape at the bottom of the die at the time of completion of forming, as the work is pushed up for demolding, strong elastic recovery action acts on the maximum tooth thickness portion and weak elastic recovery action acts on the minimum tooth thickness portion, so that crowned tooth flanks are formed. As a matter of course, the crowning amount of the work can be controlled by changing the crowning amount of the die.

Figure 9A:
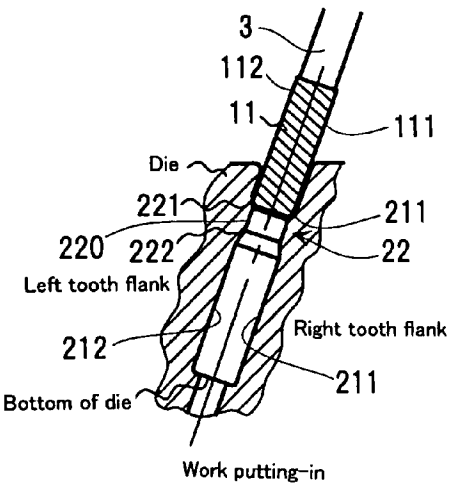
FIGS. 9A-9D are the second each partial enlarged sectional view explaining each molding process according to the first embodiment of the present invention.

This will be described in greater detail with reference to FIGS. 9A-9C.

Figure 9B:
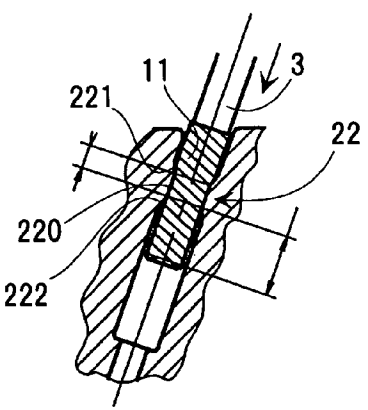

In FIG. 9B, showing the middle of forming the range shown by arrows corresponding to the land 22 shows a range of a tooth flank to be formed by the land 22, and elastic recovery acts on the tooth flank in the range shown by the arrows which has passed through the land 22.

In the middle of forming, the helical tooth flank 11 of the work is formed by the tapered portion A on the left side. The ironing amount is 0.05 to 0.3 in the tooth thickness direction. Stresses applied according to ironing are greater on the right tooth flank 111 of the helical tooth portion 11.

Figure 9C:
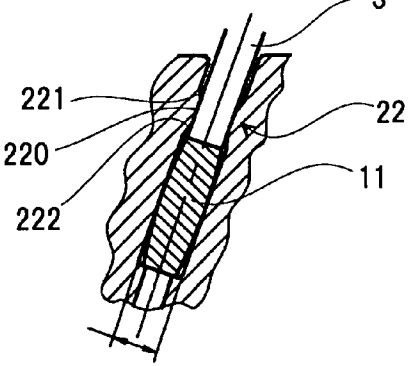
Figure 9D:
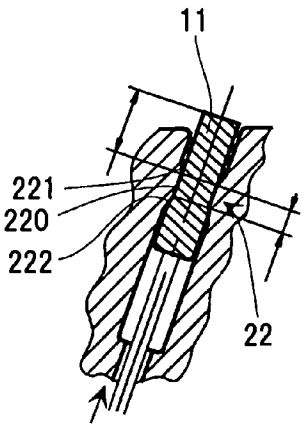

As shown in FIG. 9C, showing a completion of forming at the helical tooth portion 11 of the work reaching the bottom of the die, spreading is caused by pressing-down. The helical tooth portion 11 of the work that has passed through the land 22 is wider than the inner width of the land due to elastic recovery in the wide space below the tapered portion B of the exit tapered portion 222. At the helical tooth portion 11 of the work pushed into the bottom of the die by the punch 3, spreading is caused by pressing-down. Synergy of the above-described actions acts on the lower side of the tapered portion B. The unbalanced stresses between the left and right sides applied during forming are maintained.

As shown in FIG. 9C, showing the middle of demolding elastic recovery acts on the tooth flank that has passed through the land 22. The helical tooth flank 11 of the work is formed again by the tapered portion B. That is, the helical tooth flank 11 of the work that has become wider inside the die according to forming is ironed again by the tapered portion B. Contrary to forming to the right tooth flank 111, a stronger stress than to the left tooth flank 112 is applied by an upward force.

Figure 5A:
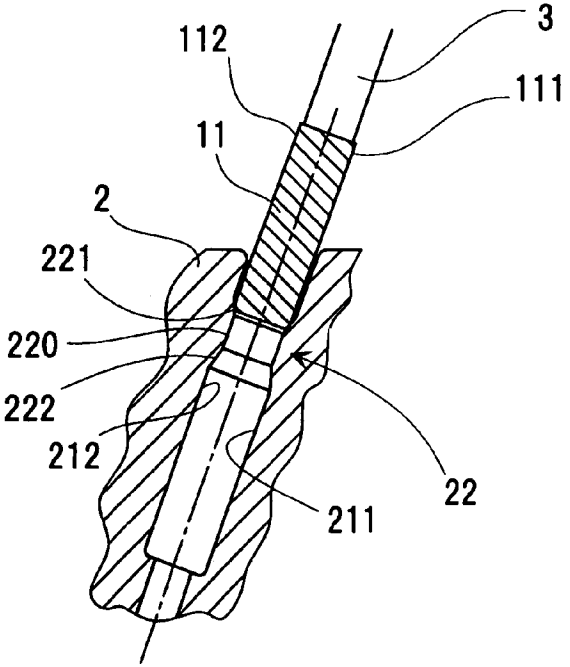
FIGS. 5A-5C are a partial enlarged sectional view taken along B-B line in FIG. 4 showing the main portion according to the first embodiment of the present invention, a partial enlarged sectional view explaining the stressed portion on the method for manufacturing according to the first embodiment of the present invention, and an explanation figure explaining the distribution of internal stresses within the helical tooth portion as the work according to the first embodiment of the present invention.
Figure 5B:
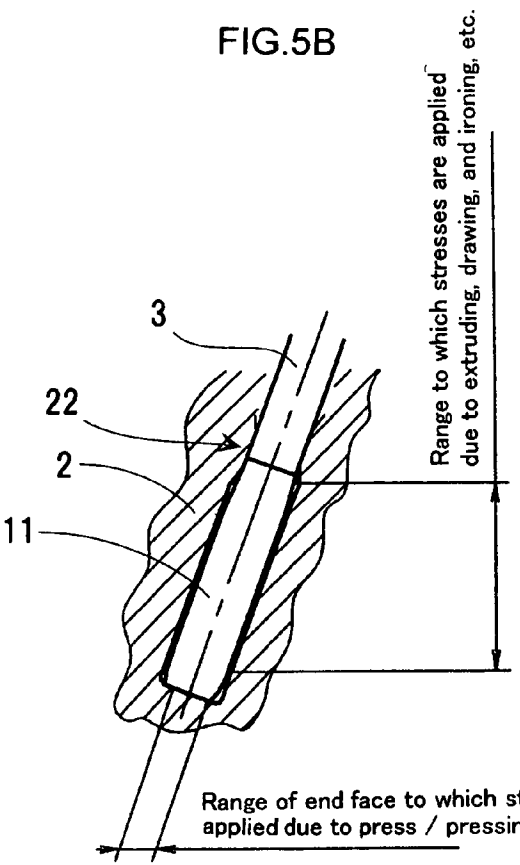
Figure 5C:
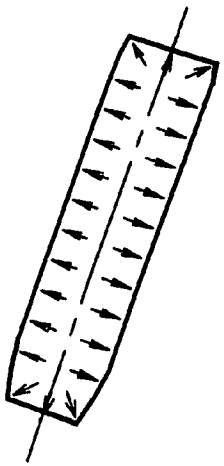
Figure 10:
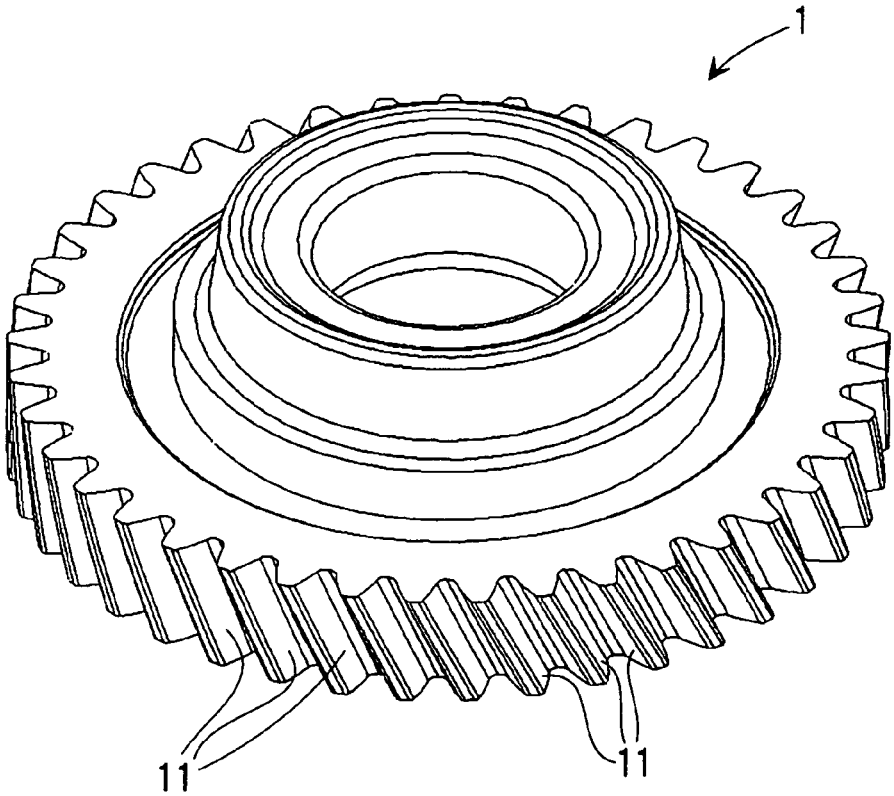
FIG. 10 is an oblique perspective view showing the helical gear manufactured by the manufacturing apparatus according to the first embodiment of the present invention.
Figure 16:
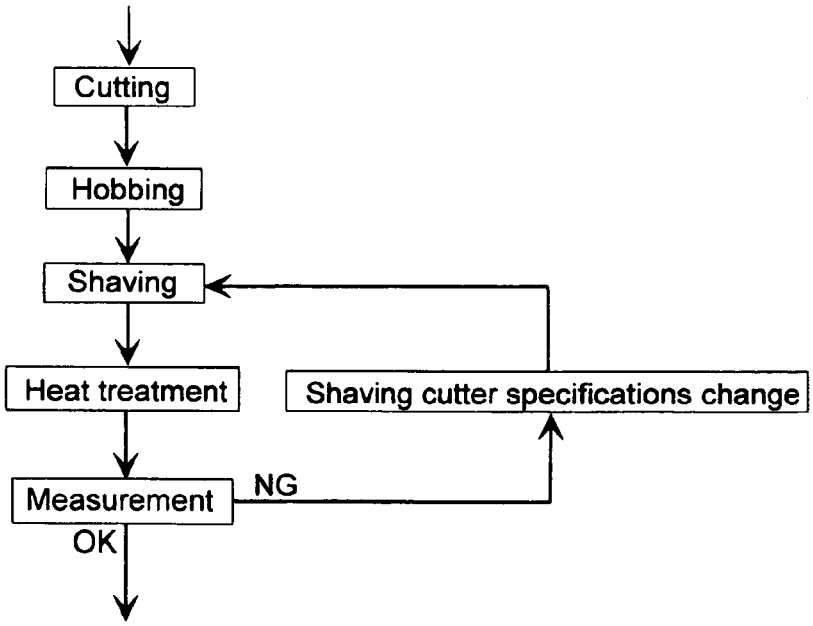
FIG.16 (PRIOR ART)
FIG. 16 is a chart diagram showing each process of manufacturing the helical gear on conventional hobbing.
Figures 11A, 11B, 11C, 11D:
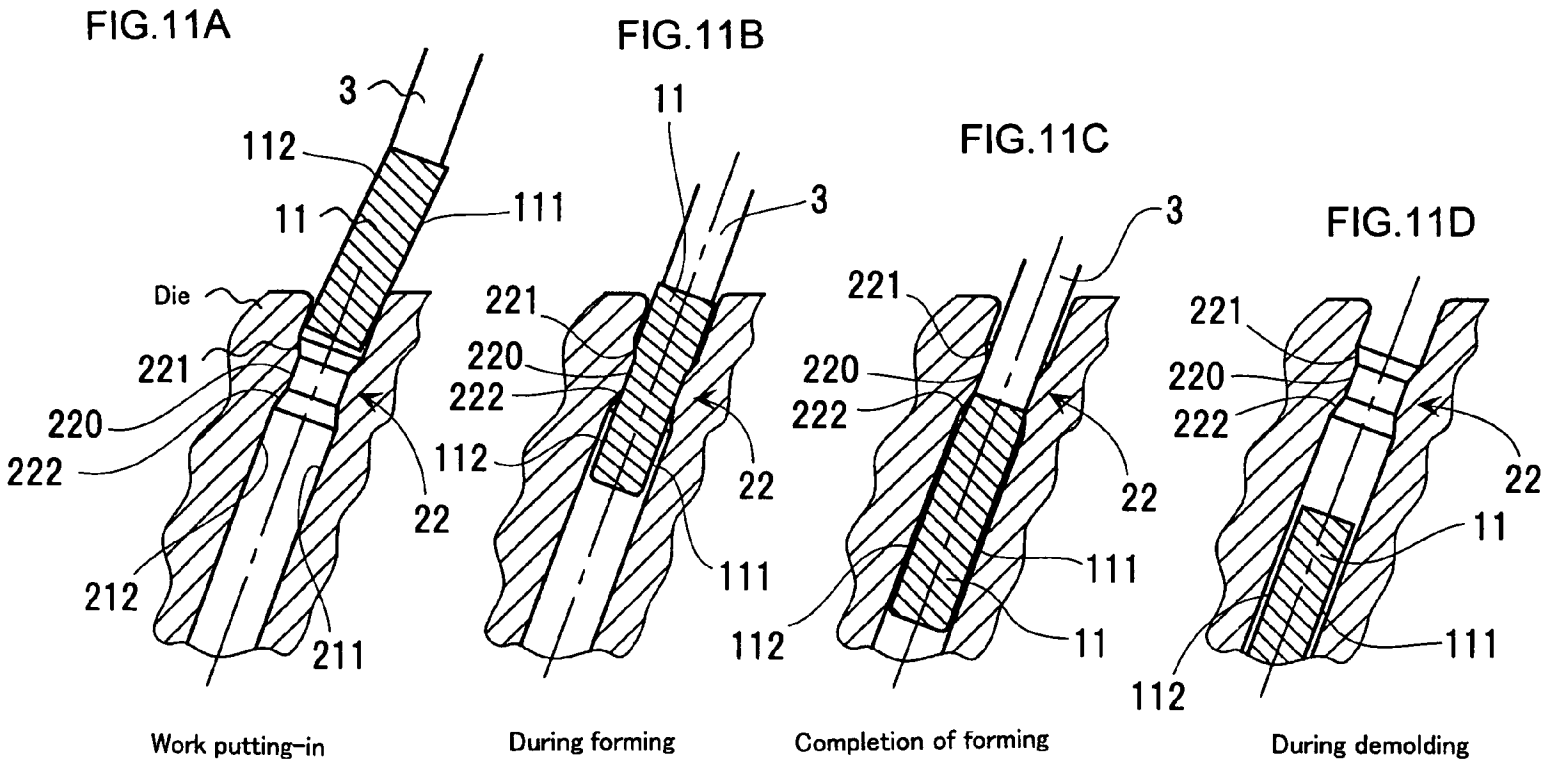
FIGS. 11A-11D are each partial enlarged sectional view explaining each molding process according to the second embodiment of the present invention.

A helical gear shown in FIG. 10, manufactured according to the apparatus and a method for manufacturing a helical gear of the first embodiment described above, comprises the helical tooth portions 11 of the helical gear being worked by the punch 3 and the die 2 having the land 22 of a smaller distance between opposed working surfaces 21 formed to be inclined than that of other portion, formed on predetermined portions in tooth directions of respective opposed working surfaces thereon, in which the worked surfaces 111 and 112 on both side of the helical tooth portions 11 on the helical gear as a work 1 are ironed perpendicularly from both sides by the land 22 in response to the helical tooth portions 11 passing through the parallel portions 220 of the lands 22 when the work 1 is forged by the punch 3 as shown in FIG. 5B. Therefore, internal stresses (stress directions are tooth flank normal directions) can be uniformly applied to the cross section of the tooth, so that as shown in FIG. 5C, vectors of the internal stresses inside the work 1 are made uniform, that is, equal, whereby heat treatment distortion is minimized.

An apparatus for manufacturing a helical gear of the first embodiment, which brings about the above-described effect, comprises the die 2 for working helical tooth portions 11 of the helical gear as a work 1, the land 22, having a smaller distance between opposed working surfaces 21 formed to be inclined than that of other portions, formed on predetermined portions in tooth directions of respective opposed working surfaces on the die 2, and the punch 3 for forging the work 1, in which worked surfaces on both side of the helical tooth portions 11 on the helical gear are ironed perpendicularly by the land 22 in response to the helical tooth portions 11 passing through the parallel portions 220 of the lands 22 when the work 1 is forged by the punch 3. Therefore, by making uniform, that is, equal the vectors of internal stresses inside the work without generating a moment, a helical gear with minimized heat treatment distortion can be manufactured.

According to the apparatus for manufacturing a helical gear of this first embodiment, the helix angle of the opposed working surface 21 of the die 2 is greater than the helix angle of the helical tooth portion 11 of the helical gear as the work 1, so that the internal stresses inside the tooth flanks after being forged are made uniform.

Further, according to the apparatus for manufacturing a helical gear of this first embodiment, the land 22 has the entrance tapered portion 221 at which the distance between opposed surfaces becomes gradually narrower and the exit tapered portion 222 at which the distance between opposed surfaces becomes gradually wider, so that when the work 1 is pressure-forged with the punch 3, worked surfaces on both sides of the helical tooth portion 11 can be smoothly ironed when the helical tooth portion 11 passes through the land 22.

According to the apparatus for manufacturing a helical gear of this first embodiment, a parallel portion 220 at which the distance between opposed surfaces is constant is formed between the entrance tapered portion 221 and the exit tapered portion 222, so that worked surfaces 111 and 112 on both sides of the helical tooth portion 11 of the helical gear as the work 1 are ironed perpendicularly from both sides without generating a moment, and therefore, reliable and uniform ironing can be applied.

Further, according to the apparatus for manufacturing a helical gear of this first embodiment, as shown in FIGS. 6A-6C, the ironing allowance on the acute-angled surface side of the land is set to be larger than the ironing allowance on the obtuse-angled surface side. The helical tooth portion 11 of the work 1 is made to reciprocate ascending and descending with respect to the land 22 for ironing, so that ironing is applied while the acute-angled surface side and the obtuse-angled surface side of the working surface are switched to each other between the ascending and descending, so that the scattering of internal stresses inside the tooth flanks as left and right worked surfaces after being forged is reduced.

Second Embodiment

An apparatus and a method for manufacturing a helical gear according to the second embodiment are different from those of the above-described first embodiment in the point of employing a punch-dropping method in which the work 1 is only moved downwards with respect to the lands 22 as shown in FIGS. 11A-11D although the helical tooth portions 11 of the work 1 are made to reciprocate ascending and descending, i.e., moving downwards and upwards with respect to the lands 22 for ironing in the first embodiment, and this difference will be mainly described below.

As to the apparatus and a method for manufacturing a helical gear according to the second embodiment of the present invention, the case using a forming method called "punch-dropping method," in which the work 1 is dropped through a die by punching of a punch 3, will be described.

In the forming method according to the second embodiment of the present invention, forming using the demolding as shown in FIGS. 8A-8D of the first embodiment described above cannot be employed, so that a target work shape is obtained by using the idea shown in FIGS. 6A-6C.

In order that the helical tooth portion 11 of the work 1 come out smoothly from the parallel portion 220 as shown in FIGS. 11A-11D, as the first embodiment described above, the land 22 has an entrance tapered portion 221 at which the distance between opposed surfaces becomes gradually narrower, an exit tapered portion 222 at which the distance between opposed surfaces becomes gradually wider, and a parallel portion 220 which is formed between the entrance tapered portion 221 and the exit tapered portion 222 and at which the distance between the opposed surfaces is constant and shortest. However, it is also allowed that a stepped shape portion is formed instead of the exit tapered portion 222.

In the forming method according to the second embodiment of the present invention, a work is put in the die 2 having the lands 22 and pressure-forged with the punch 3. At this time, the width of the work 1 is set to be slightly wider than the inner width of the parallel portion 220 of the land 22 so that a proper ironing amount is obtained. The helix angle of the work 1 is set to be greater than that of the die, whereby during foaming the ironing amount on the left tooth flank in the drawing is always larger than that on the right side.

To both tooth flanks of the work 1 formed according to the above-described method, uniform internal stresses are applied at the time of demolding, so that the deformation after heat treatment can be minimized.

In the case of forming (forging and pressing) with a press machine, a force is applied downward vertically, so that a stronger force is applied to the obtuse-angled side in the die 1 for a helical gear. Therefore, when the left and right tooth flanks are compared, the degrees of forming thereof are different, and their deformation amounts after heat treatment are different from each other. In the conventional method, a die with mutually different helix angles between the left and the right must be used, so this makes die manufacturing complicated and results in an increase in cost. However, in the second embodiment of the present invention, this problem is solved.

Third Embodiment

Figure 12:
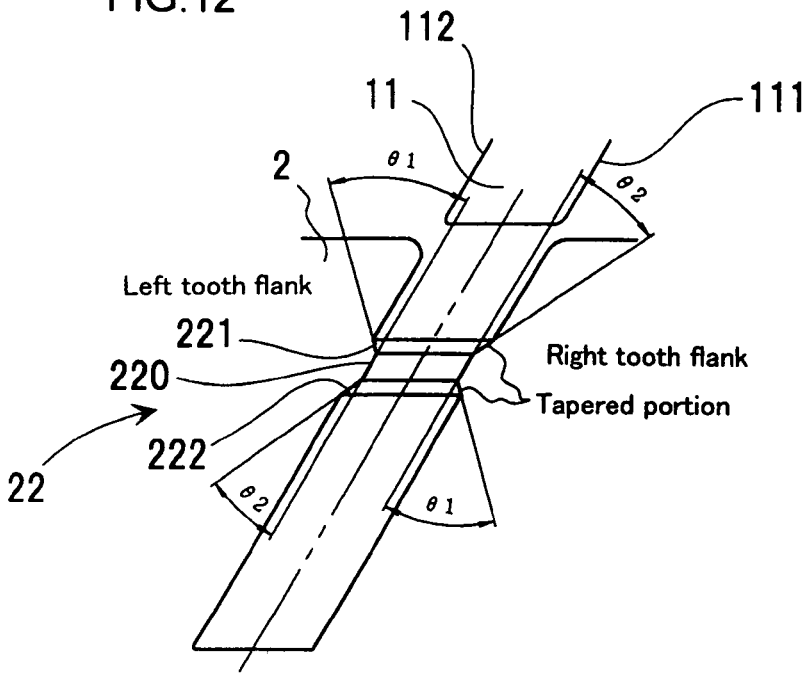
FIG. 12 is a partial enlarged sectional view showing the main portion according to the third embodiment of the present invention.

An apparatus and a method for manufacturing a helical gear according to the third embodiment of the present invention are different from those of the above-described embodiments mainly in that, although the above-described embodiments need cutting of projecting portions on the upper and lower end faces after forming to enable perpendicular ironing from both sides by the lands 22 since the upper and lower end faces of the helical tooth portions are not horizontal, ironing is performed by using horizontal lands 22 in order to make the cutting unnecessary and in order to enable forming of horizontal upper and lower end faces of the helical tooth portions as shown in FIG. 12. Those differences will be mainly described below.

According to the apparatus and a method for manufacturing a helical gear of this third embodiment, provision of the tapered portions and the lands in the tooth perpendicular direction as shown in the embodiments described above makes die design and manufacturing complicated, so that the present invention can also employ the embodiment shown in FIG. 12 as easy application.

As seen in FIG. 12, the start position of the entrance tapered portion 221 is parallel to the upper surface of the die 2, that is, orthogonal to the axial direction of the helical gear. The end position of the exit tapered portion 222 is parallel to the upper surface of the die 2. Accordingly, a die in which the lands 22 are shaped so as to be parallel to the upper surface of the die 2 and the angles of the left and right tapered portions satisfy $\theta 1/\theta 2$, is used.

As advantages of the third embodiment of the present invention, forming of the helical tooth portions having horizontal upper and lower end faces whose corners are chamfered is possible, the die design and manufacturing are easy. The same effects as the above-described embodiments are obtained by using the material with a changed helix angle. It is possible that the land portion and the tapered portion are arranged on the inner periphery of the die along the entire circumference of the tooth shapes, and that the end faces of the material are shapes parallel to the upper surface of the die 2.

Further, this third embodiment brings about a function and an effect that cutting conventionally needed for projecting portions on the upper and lower end faces after forming due to the upper and lower end faces of the helical tooth portions being not horizontal in order to enable perpendicular ironing from both sides by the lands 22, is made unnecessary. The working process can be simplified and the cutting of the grain flow at the helical tooth portions 11 is avoided. Therefore, the strength of the helical tooth portions 11 can be improved.

Fourth Embodiment

Figure 13:
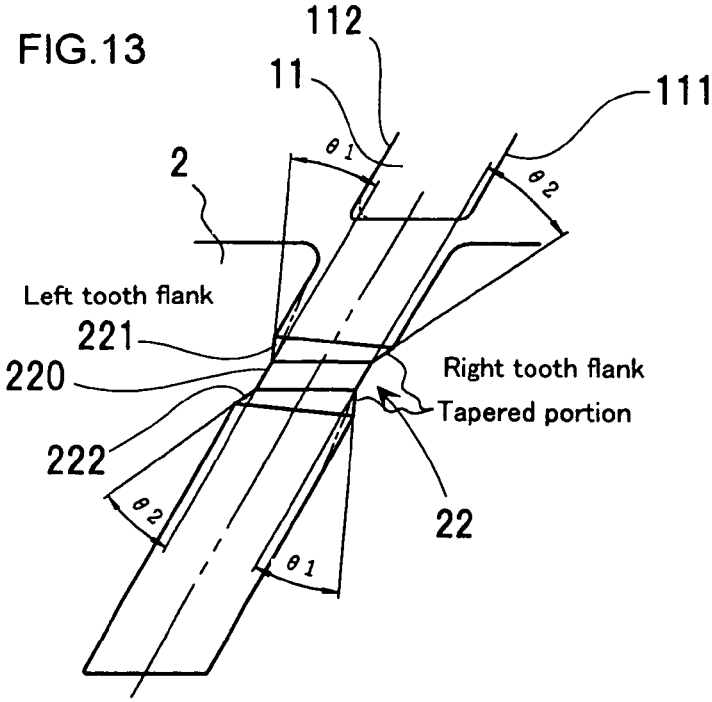
FIG. 13 is a partly enlarged sectional view showing the main portion according to the fourth embodiment of the present invention.

An apparatus and a method for manufacturing a helical gear of the fourth embodiment of the present invention are different from those of the above-described third embodiment in that left and right inclination angles of the entrance tapered portion 221 and the exit tapered portion 222 are substantially equal to each other as shown in FIG. 13 although the left and right inclination angles of the entrance tapered portion 221 and the exit tapered portion 222 are different from each other in the third embodiment. This difference will be mainly described below.

According to the apparatus and a method for manufacturing a helical gear of the fourth embodiment of the present invention, the angles of the entrance tapered portion 221 and the exit tapered portion 222 are equal between the left tooth flank and the right tooth flank, and the end position of the tapered portion is parallel to the upper surface of the die 2. Accordingly, a die having a tooth-shaped portion including the land portion 22 being parallel to the upper surface of the die 2 and angles of the tapered portions satisfying $\theta 1=\theta 2$, is used.

In this fourth embodiment, an additional change is added to the shape shown in the third embodiment described above. As described later, the die design and manufacturing are easy and the effects of the present invention are favorably obtained.

This fourth embodiment has the advantages that forming of the helical tooth portions having horizontal upper and lower end faces whose corners are chamfered is possible. The die design and manufacturing are easy, and even if a special material is not used, the equivalent effect is obtained. The land portions and the tapered portions can be arranged on the inner periphery of the die along the entire circumference of the tooth shapes. The end faces of the material are shapes parallel to the die upper surface of the die.

In this fourth embodiment, the left and right inclination angles of the entrance tapered portion 221 and the exit tapered portion 222 are substantially equal to each other, so the unbalanced ironing from the left and right surfaces of the entrance tapered portion 221 and the exit tapered portion 222 of the helical tooth portion 11 is reduced. Therefore, the gained effect is that the distribution of internal stresses on the tooth flanks after being forged are made uniform.

The above-described embodiments are illustrated for description, and the present invention is not limited to these but can be subjected to changes and additions without deviating from the technical idea of the present invention that a person skilled in the art can recognize from the claims, the detailed description, and the description of drawings of the present invention.

In the above-described first embodiment, an example in which the left and right inclination angles of the entrance tapered portion 221 and the exit tapered portion 222 are set to be substantially equal to each other is described. However, the present invention is not limited to this. An embodiment can be employed in which, in order to smoothly iron the corners on the obtuse-angled sides of the horizontal upper and lower end faces of the helical tooth portion which are to be severely ironed, as shown by the dashed lines in FIG. 13, the chamfering amount of the obtuse-angled side corners is set to be greater than that of the acute-angled side corners, or as shown by the alternate long and short dashed line in FIG. 13, the inclinations of the entrance tapered portion 221 on the left side in the drawing and the exit tapered portion 222 on the right side in the drawing which the iron obtuse-angled sides are set to be much gentler than the inclinations of the opposite tapered portions 221 and 222 which the iron acute-angled side corners to widen the range of ($\theta_1 << \theta_2$) so that ironing is gradually performed.

Figure 14:
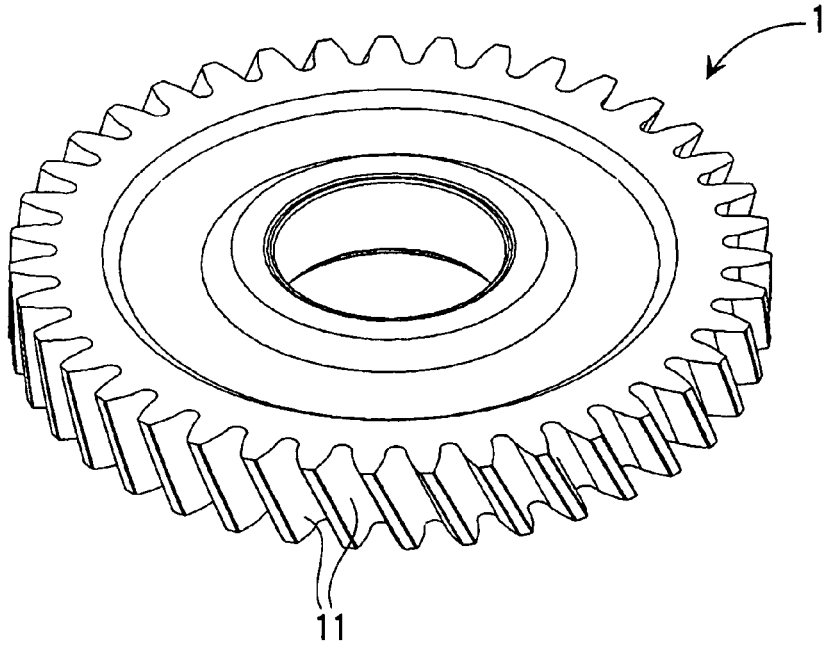
FIG. 14 is an oblique perspective view showing an another helical gear manufactured by the apparatus according to the embodiment of the present invention.
Figure 15:
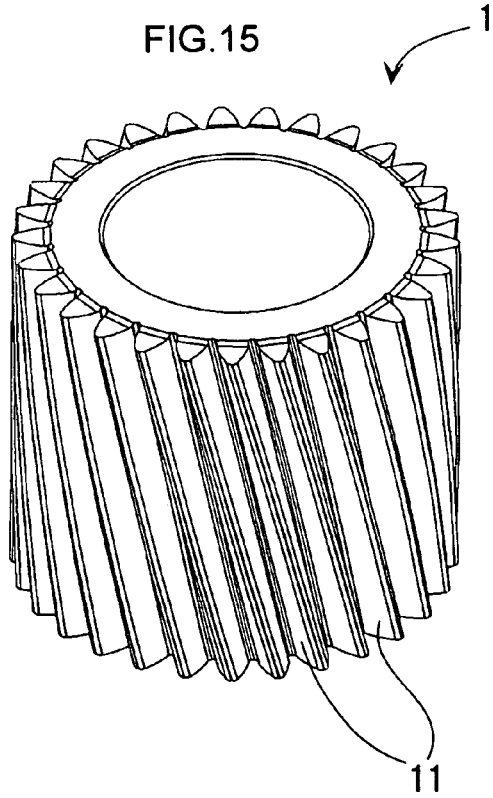
FIG. 15 is an oblique perspective view showing the other helical gear manufactured by the apparatus according to the embodiment of the present invention.
Figure 17A:
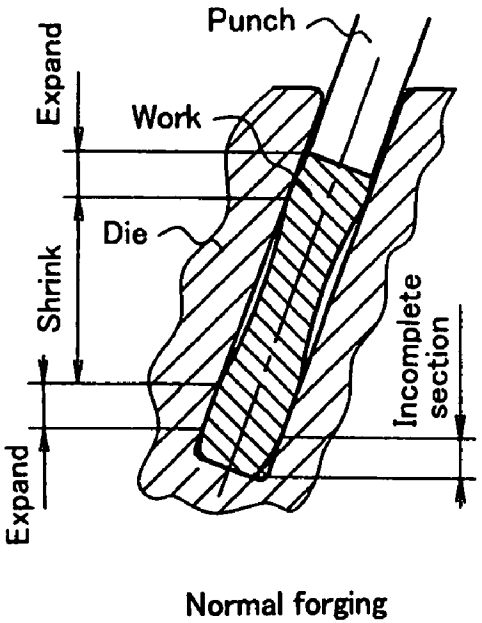
FIG.17A (PRIOR ART)
FIGS. 17A and 17B are explanatory drawings explaining an expanded portion and a shrunk portion of the helical tooth portion as the work in the forging apparatus using a die in the conventional method.
Figure 17B:
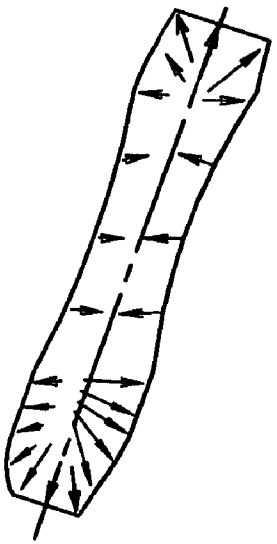
FIG.17B (PRIOR ART)
Figure 18:
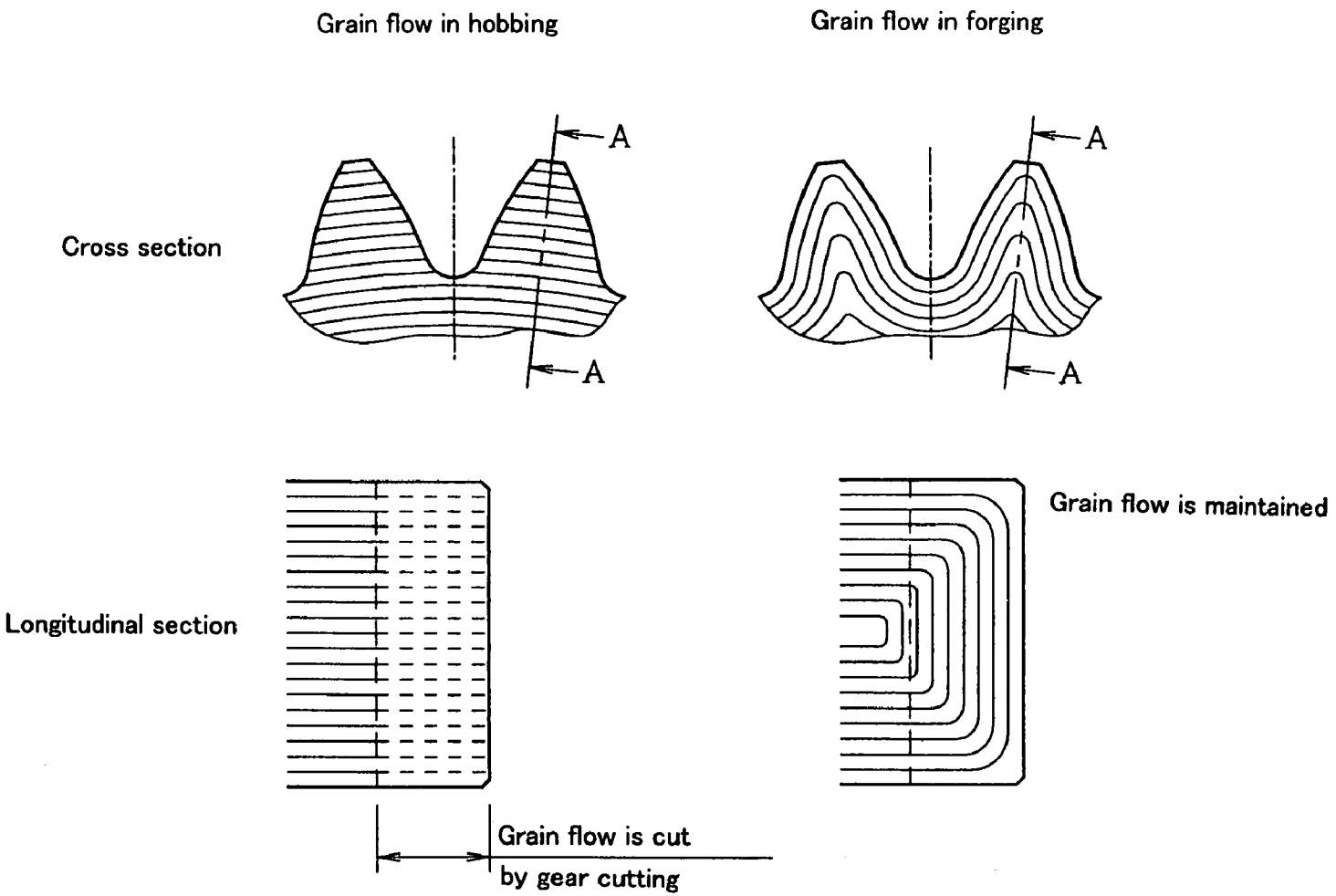
FIG.18 (PRIOR ART)
FIG. 18 is an explanatory drawing explaining a state of grain flow in the case the helical gear is manufactured by bobbing and forging in the conventional method.
Figure 19:
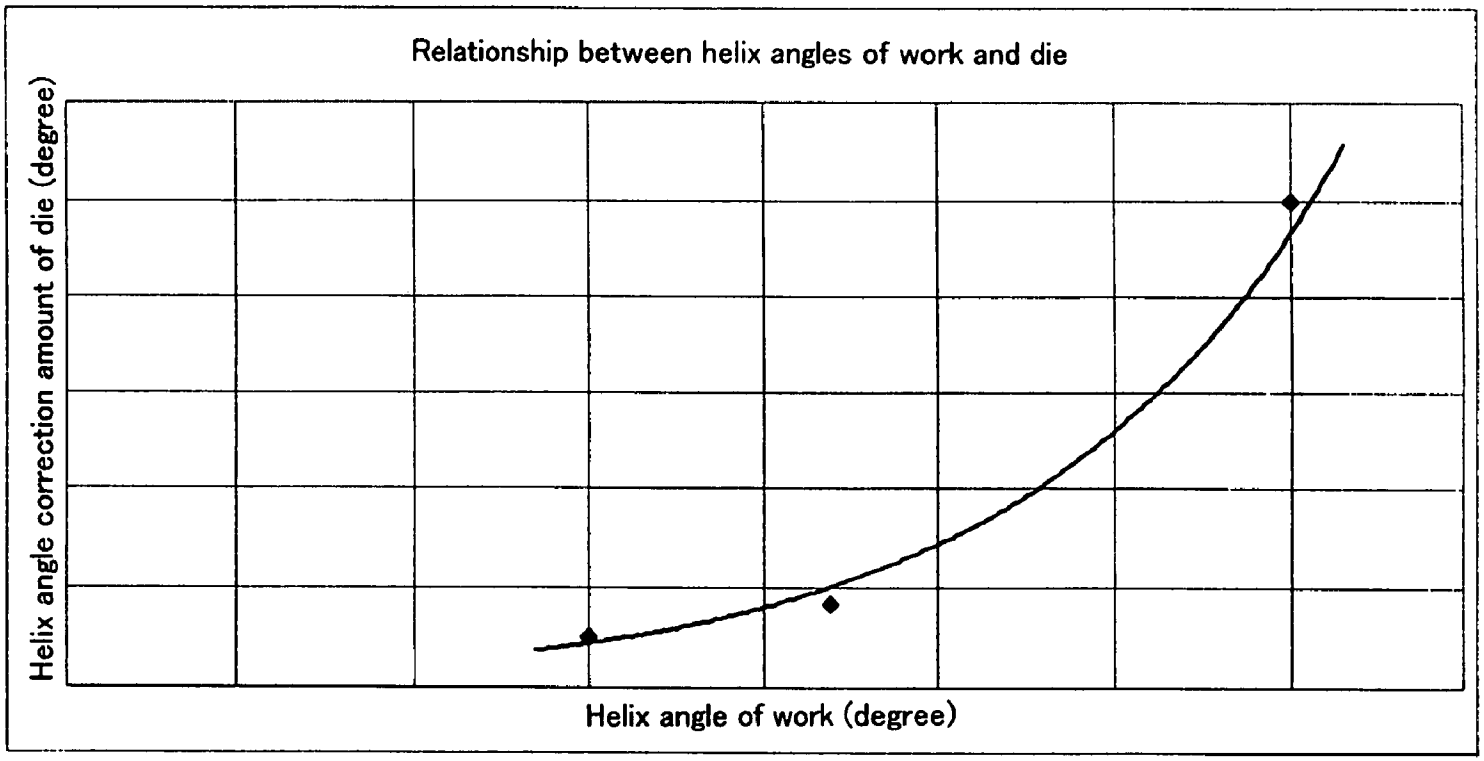
FIG.19 (PRIOR ART)
FIG. 19 is a diagram showing relationship between helix angles of work and die in the forging apparatus using a die in the conventional method.

In the first embodiment described above, an example in which the gear with a hub shown in FIG. 10 is manufactured is described. The present invention is not limited to this, and as shown in FIGS. 14 and 15, as a matter of course, a gear without a hub can also be manufactured.

INDUSTRIAL APPLICABILITY

In the helical gear, the apparatus and the method for manufacturing the helical gear in a die for working helical tooth portions of a helical gear as a work, having a land of a smaller distance between opposed working surfaces formed to be inclined than that of other portions formed on predetermined portions in tooth directions of respective opposed working surfaces on the die, worked surfaces on both side of the helical tooth portions on the helical gear are ironed by the land in response to the helical tooth portions passing through the land when the work is forged by a punch, so that the gear, the apparatus and the method for manufacturing the helical gear can be applied to an application that by making uniform, that is, equal, the vectors of internal stresses inside the helical tooth portions of the helical gear as the work, a helical gear with minimized heat treatment distortion can be manufactured.

What is claimed is:

1. An apparatus for manufacturing a helical gear, comprising a die for working helical tooth portions of the helical gear as a work piece, a plurality of pairs of lands, each land being formed on a predetermined portion in a tooth direction of each respective opposed working surface on said die, the opposed working surfaces being formed at an incline corresponding to a helix angle with respect to an axial direction of the die, and each pair of lands defining a smaller distance between opposed working surfaces than a distance between other portions of the opposed working surfaces, and a punch for forging said work piece, wherein forging the work piece by the punch causes the helical tooth portions to pass through the lands, thereby causing worked surfaces on both side of said helical tooth portions on said helical gear to be ironed by the lands, and forging the work piece by the punch includes applying a pressure to a face of a tooth profile of the work piece by the punch in a direction that is perpendicular to the tooth profile and that is set at an angle approximate to the helix angle.

2. The apparatus for manufacturing a helical gear according to claim 1, wherein the helix angle of the opposed working surfaces to the axial direction of said die is different from a helix angle of the helical tooth portions of said helical gear as a work piece.

3. The apparatus for manufacturing a helical gear according to claim 2, wherein the helix angle of the opposed working surfaces of said die is greater than the helix angle of the helical tooth portions of the helical gear as a work piece.

4. The apparatus for manufacturing a helical gear according to claim 1, wherein each land has an entrance tapered portion at which the distance between opposed surfaces becomes gradually narrower, and an exit tapered portion at which the distance between opposed surfaces becomes gradually wider.

5. The apparatus for manufacturing a helical gear according to claim 4, wherein each land has a parallel portion with a constant distance between opposed surfaces between said entrance tapered portion and said exit tapered portion.

6. The apparatus for manufacturing a helical gear according to claim 5, wherein an ironing allowance of a working surface on an acute-angled surface side of each land is set to be larger than an ironing allowance on an obtuse-angled surface of each land.

* * * * *